US008961116B2

(12) United States Patent
Lawson, Jr. et al.

(10) Patent No.: US 8,961,116 B2
(45) Date of Patent: Feb. 24, 2015

(54) EXHAUST PLENUM FOR GAS TURBINE

(75) Inventors: Laquinnia Lawson, Jr., Tulsa, OK (US); Stephen W. Bigham, Bartlesville, OK (US)

(73) Assignee: Braden Manufacturing, LLC, Tulsa, OK (US)

( * ) Notice: Subject to any disclaimer, the term of this patent is extended or adjusted under 35 U.S.C. 154(b) by 346 days.

(21) Appl. No.: 13/477,849

(22) Filed: May 22, 2012

(65) Prior Publication Data

US 2013/0315721 A1 Nov. 28, 2013

(51) Int. Cl.
*F01D 25/30* (2006.01)

(52) U.S. Cl.
CPC ..... *F01D 25/30* (2013.01); *F05D 2240/55* (2013.01)
USPC ..... 415/177; 415/135; 415/174.2; 415/213.1

(58) Field of Classification Search
USPC ..... 415/108, 135, 168.1, 170, 174.2, 177, 415/213.1, 220
See application file for complete search history.

(56) References Cited

U.S. PATENT DOCUMENTS

| | | | | |
|---|---|---|---|---|
| 1,269,998 | A * | 6/1918 | Baumann | 60/697 |
| 3,630,635 | A * | 12/1971 | Fatum | 415/214.1 |
| 4,326,832 | A * | 4/1982 | Ikeda et al. | 415/213.1 |
| 5,108,258 | A * | 4/1992 | Gros | 415/213.1 |
| 7,934,904 | B2 * | 5/2011 | Demiraydin et al. | 415/207 |
| 8,221,053 | B2 * | 7/2012 | Predmore et al. | 415/108 |
| 8,221,054 | B2 * | 7/2012 | Rao et al. | 415/108 |

OTHER PUBLICATIONS

Drawings of exhaust plenum for General Electric gas turbine frame FS-6; on sale at least as early as May 21, 2011; 4 pages.

* cited by examiner

*Primary Examiner* — Igor Kershteyn
(74) *Attorney, Agent, or Firm* — Senniger Powers LLP

(57) ABSTRACT

An exhaust plenum for connection to an exhaust outlet portion of a gas turbine for receiving turbine exhaust gas. The exhaust plenum includes a first wall. The first wall includes a seal attachment component in thermal contact with an exterior shell of the first wall and is adapted for attaching an annular flex seal to the first wall. The seal attachment component extends generally around a perimeter of the inlet of the exhaust plenum, and is thermally insulated from an interior space of the exhaust plenum.

20 Claims, 14 Drawing Sheets

EXHAUST PLENUM FOR GAS TURBINE

FIELD OF THE DISCLOSURE

The present disclosure generally relates to an exhaust plenum for a gas turbine.

BACKGROUND

A gas turbine system for a power generation system typically includes a gas turbine engine, a generator operatively coupled to the gas turbine engine, an air inlet system, and an exhaust system for receiving exhaust gas from the gas turbine engine. The exhaust outlet portion of the gas turbine is connected to an exhaust plenum of the exhaust system in such a way to provide a seal so that no exhaust leaks to the outside or ambient air through the connection. To this end, flex seals for sealing the exhaust plenum to the gas turbine are secured to a forward wall of the exhaust plenum. The forward wall includes thermally conductive continuous rolled attachment bars for attaching the flex seals to the forward wall. In one conventional exhaust plenum, these attachment bars are uninsulated and exposed to the hot exhaust gas flowing inside the exhaust plenum. The inventors of the present invention have identified the uninsulated attachment bars as being possible points of failure of the exhaust plenum because the threaded bars are heated to a different temperature than the exterior shell of the forward wall, and the resulting thermal differential leads to deformation, and possibly failure, of the exhaust plenum.

In one conventional exhaust plenum, the forward wall and an aft wall each include upper and lower wall sections that are secured to one another by flange plates extending outward from exterior surfaces of the respective upper and lower wall sections. A high temperature cloth gasket is installed between the flange plates. The inventors of the present invention have identified these conventional flange plates as being a possible point of failure of the exhaust plenum because thermal expansion of the attachment bars causes the flange plates to separate and the flex seals to buckle, which leads to exhaust gas leaking from the exhaust plenum.

SUMMARY

In one aspect, an exhaust plenum for connection to an exhaust outlet portion of a gas turbine for receiving turbine exhaust gas therefrom generally comprises an interior space, a first wall defining an inlet of the exhaust plenum through which exhaust gas from the exhaust outlet portion of the gas turbine enters the interior space of the exhaust plenum, and a second wall defining an outlet of the exhaust plenum through which exhaust gas exits the interior space of the exhaust plenum. The first wall includes an exterior shell having an interior-facing surface. An interior liner of the first wall has an exterior-facing surface, and the exterior-facing surface of the interior liner generally opposes and is spaced apart from the interior-facing surface of the exterior shell to at least partially define a wall cavity therebetween. A seal attachment component of the first wall is in thermal contact with the exterior shell of the first wall and is adapted for attaching an annular flex seal to the first wall. The seal attachment component extends generally around a perimeter of the inlet of the exhaust plenum, and is thermally insulated from the interior space of the exhaust plenum.

In another aspect, a gas turbine system generally comprises a gas turbine including a rotatable turbine shaft, and an exhaust outlet portion through which turbine exhaust gas exits the gas turbine; and an exhaust plenum connected to the exhaust outlet portion of the gas turbine for receiving turbine exhaust gas therefrom. The exhaust plenum includes an interior space; a first wall defining an inlet of the exhaust plenum through which exhaust gas from the exhaust outlet portion of the gas turbine enters the interior space of the exhaust plenum; and a second wall defining an outlet of the exhaust plenum through which exhaust gas exits the interior space of the exhaust plenum. The first wall of the exhaust plenum includes an exterior shell having an interior-facing surface. An interior liner of the first wall has an exterior-facing surface, and the exterior-facing surface of the interior liner generally opposes and is spaced apart from the interior-facing surface of the exterior shell to at least partially define a wall cavity therebetween. A seal attachment component of the first wall is attached to and in thermal contact with the exterior shell of the first wall. The seal attachment component extends along a generally arcuate path generally adjacent the perimeter of the inlet of the exhaust plenum. The seal attachment component is thermally insulated from the interior space of the exhaust plenum. An annular flex seal of the first wall is attached to the seal attachment component and extending radially inward from the seal attachment component relative to the inlet of the exhaust plenum. The annular flex seal is attached to and seals the first wall of the plenum to the exhaust outlet portion of the gas turbine.

In yet another embodiment, a method of retrofitting an exhaust plenum for a gas turbine is disclosed. The exhaust plenum includes a forward wall defining an inlet leading to an interior space of the exhaust plenum. The forward wall includes an interior liner, an exterior shell in opposing, spaced apart relationship with the interior liner to define a wall cavity therebetween, and a seal-attachment component secured to the exterior shell for use in attaching a flex seal to the forward wall. The interior liner has an inner radial liner section at a radially inner end of the interior liner relative to a center axis of the inlet for retaining thermal insulation in the wall cavity. The method of retrofitting an exhaust plenum generally comprises removing the inner radial liner section of the interior liner, removing existing thermal insulation retained in the wall cavity by the inner radial liner section of the interior liner, and securing a new thermal insulation member to the forward wall in a position adjacent to the seal attachment component such that the new thermal insulation member thermally insulates the seal attachment component from the interior space of the exhaust plenum.

In another embodiment, an exhaust plenum for connection to an exhaust outlet portion of a gas turbine for receiving turbine exhaust gas therefrom generally comprises an interior space; a first wall defining an inlet of the exhaust plenum through which exhaust gas from the exhaust outlet portion of the gas turbine enters the interior space of the exhaust plenum; and a second wall defining an outlet of the exhaust plenum through which exhaust gas exits the interior space of the exhaust plenum. The first wall includes an upper first wall section including an upper exterior liner and spaced apart right and left flange sets. Each of the right and left flange set of the upper first wall section includes vertically spaced apart upper and lower flanges extending outward from the upper exterior liner. The left upper flange of the upper first wall section has sets of openings vertically aligned with openings in the left lower flange of the upper first wall section, and the right upper flange of the upper first wall section has openings vertically aligned with openings in the right lower flange of the upper first wall section. A lower first wall section of the first wall includes a lower exterior liner and spaced apart lower right and left flange sets. Each of the lower right and left flange sets of the lower first wall section includes vertically spaced apart upper and lower flanges extending outward from the lower exterior liner. The left upper flange of the lower first wall section has openings vertically aligned with openings in the left lower flange of the lower first wall section, and the right upper flange of the lower first wall section has openings vertically aligned with openings in the right lower flange of the lower first wall section. The aligned openings in the right flange set of the upper first wall section are alignable with the respective aligned openings in the right flange set of the lower first wall section when the upper first wall section and the lower first wall section are assembled for receiving fasteners therethrough to secure the upper first wall section to the lower first wall section. The aligned openings in the left flange set of the upper first wall section are alignable with the respective aligned openings in the left flange set of the lower first wall section when the upper first wall section and the lower first wall section are assembled for receiving fasteners therethrough to secure the upper first wall section to the lower first wall section.

BRIEF DESCRIPTION OF THE DRAWINGS

Corresponding reference characters indicate corresponding parts throughout the drawings.

DETAILED DESCRIPTION OF THE DRAWINGS

Figure 1:
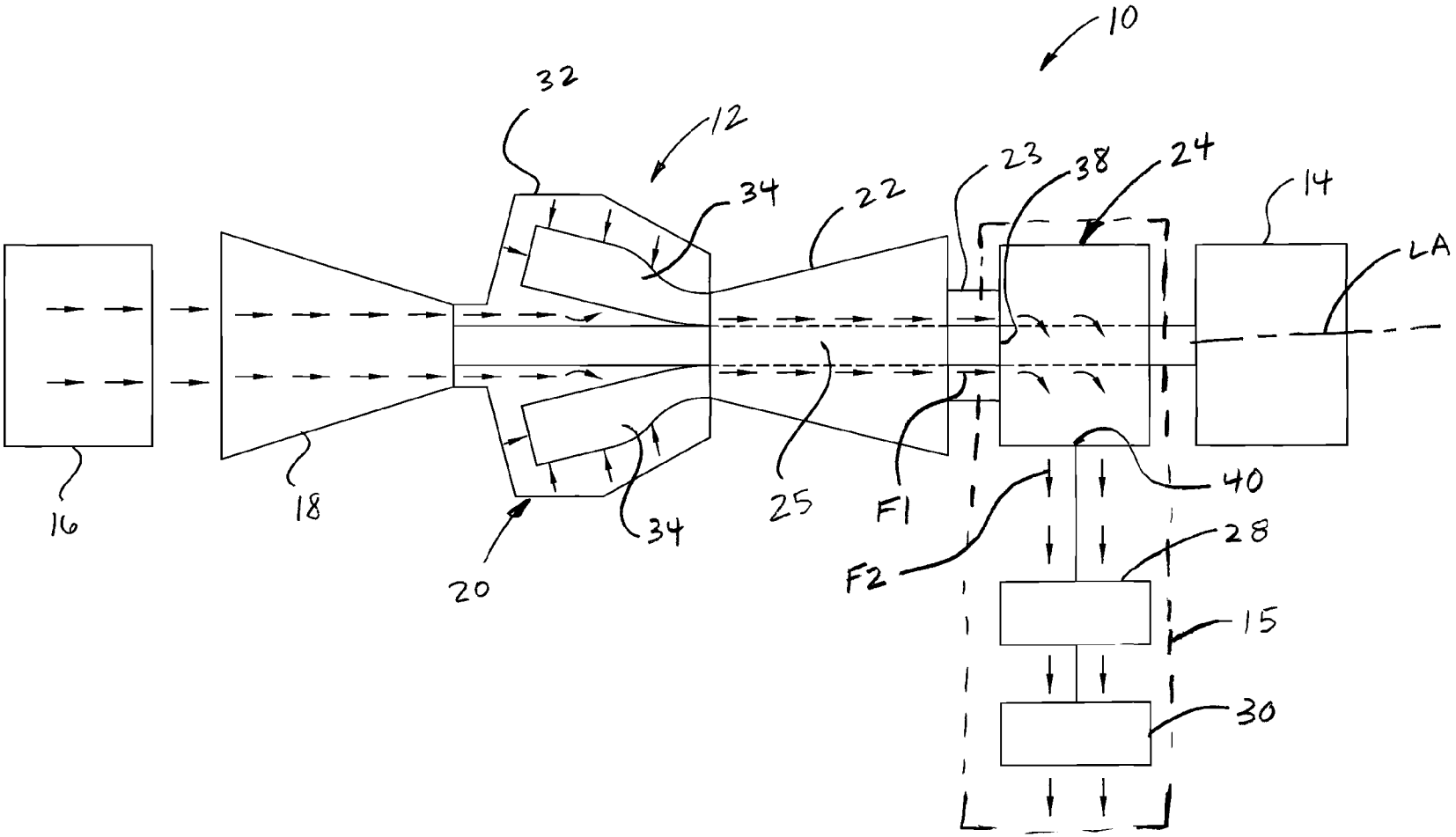
FIG. 1 is schematic illustration of one example of a gas turbine system, including an exhaust plenum.

Referring to FIG. 1, one example of a gas turbine system (shown schematically) is generally indicated at 10. In one embodiment, the system 10 may be part of a power generation system. In general, the illustrated gas turbine system 10 includes a gas turbine engine, generally indicated at 12, a load 14 (e.g., a generator) operatively coupled to the gas turbine engine, and an exhaust system 15 for receiving exhaust gas from the gas turbine engine. The gas turbine engine 12 includes an air intake section 16, a compressor 18, a combustor section, generally indicated at 20, a turbine 22, and an exhaust outlet portion 23 (which may or may not be part of the turbine) fluidly connecting the turbine and the exhaust system 15. The turbine 22 includes a drive shaft 25 having a longitudinal axis LA and operatively coupled to the load 14 for driving the load. The drive shaft 25 is also operatively coupled to the compressor 18 for driving the compressor. The exhaust system 15 includes an exhaust plenum, generally indicated at 24, that is coupled to the exhaust outlet portion 23 of the turbine engine 12. (The exhaust plenum 24 is discussed in detail below.) In the illustrated embodiment, the exhaust system 15 also includes a transition section 28 downstream from the exhaust plenum 24, and an exhaust stack 30 downstream from the transition section. It is understood that the gas turbine may be of other configurations and types without departing from the scope of the present invention. It is also understood that, other than the exhaust plenum 24, one or more of the illustrated components of the exhaust system 15 may be omitted, and/or one or more additional components may be included.

As indicated by the arrows, air enters the gas turbine system 10 through the air intake section 16 and flows into the compressor 18, which compresses the air prior to entry into the combustor section 20. The illustrated combustor section 20 includes a combustor housing 32 disposed concentrically or annularly about the drive shaft 25 intermediate the compressor 18 and the turbine 22. Compressed air from the compressor 18 enters combustors 34 where it mixes and combusts with fuel within the combustors to drive the turbine 22. From the combustor section 20, the hot combustion gases flow through the turbine 22, driving the compressor 18 and the load 14 via the drive shaft 25. For example, the combustion gases may apply motive forces to turbine rotor blades (not shown) within the turbine 22 to rotate the drive shaft 25, which drives both the load 14 and the compressor 18 in the illustrated embodiment.

After flowing through the turbine 22, the hot exhaust (or combustion) gas exits the gas turbine engine 12 and flows through the exhaust plenum 24. More specifically, the exhaust gas enters the exhaust plenum 24 through an inlet 38 of the exhaust plenum, and exits the exhaust plenum through an outlet 40. The exhaust plenum 24 directs the exhaust gas at an angle (e.g., approximately 90 degrees) away from the longitudinal axis LA of the drive shaft 25. More specifically, exhaust gas entering the exhaust plenum 24 through the inlet 38 flows along an inlet flowpath F1 that is generally parallel to the longitudinal axis LA of the drive shaft 25, and exhaust gas exiting the exhaust plenum through the outlet 40 flows along an outlet flowpath F2 that is generally transverse to (e.g., about 90 degrees offset from) the inlet flowpath. After the exhaust gas passes through the exhaust plenum 24, it passes through the transition section 28. From the transition section 28, the exhaust gas then flows through an exhaust stack 30 to the outside environment. As set forth above, other than the exhaust plenum 24, one or more of the illustrated components of the exhaust system 15 may be omitted, and/or one or more additional components may be included without departing from the scope of the present invention.

Figure 2:
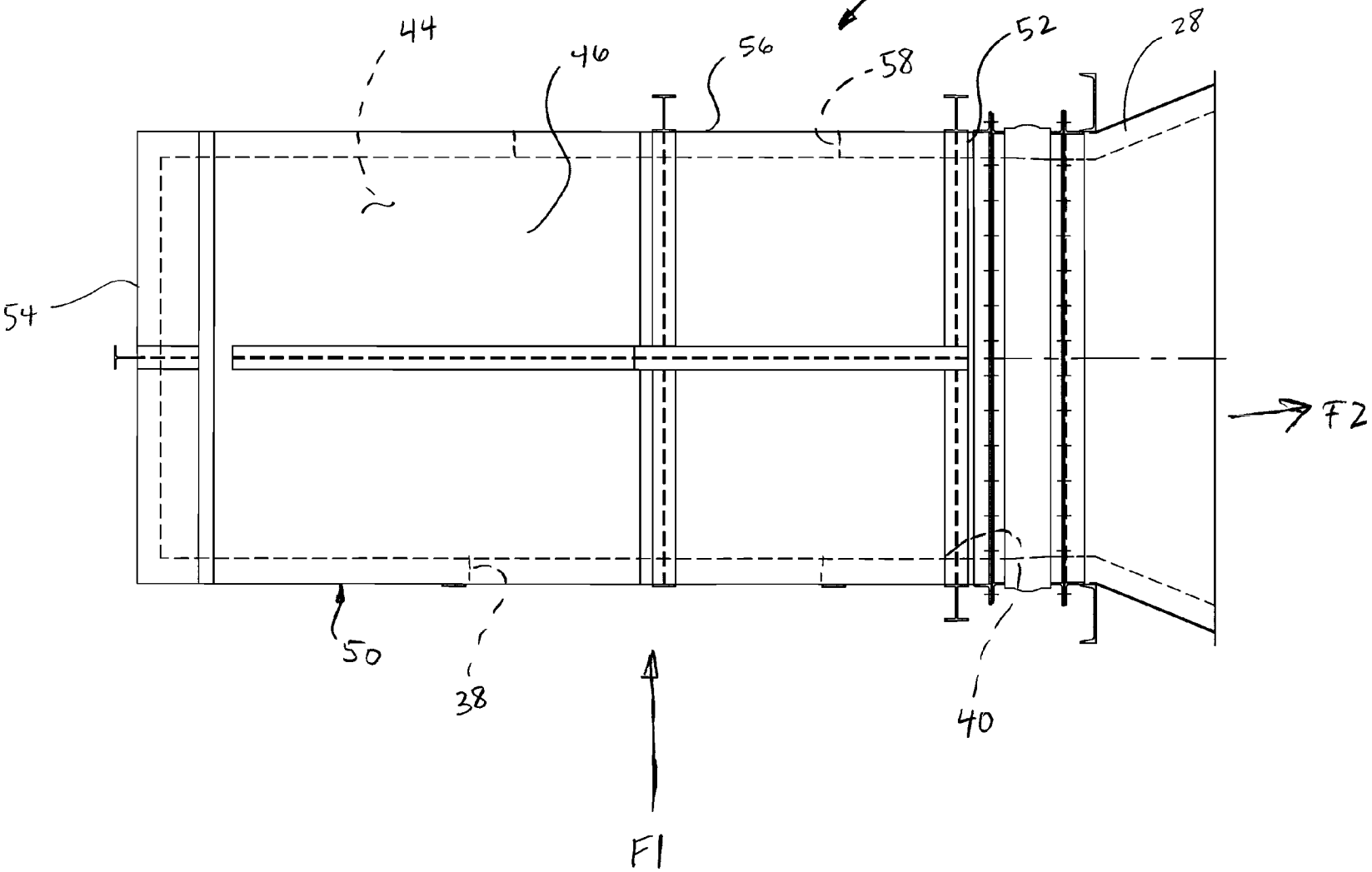
FIG. 2 is a top plan of one embodiment of the exhaust plenum of FIG. 1.
Figure 3:
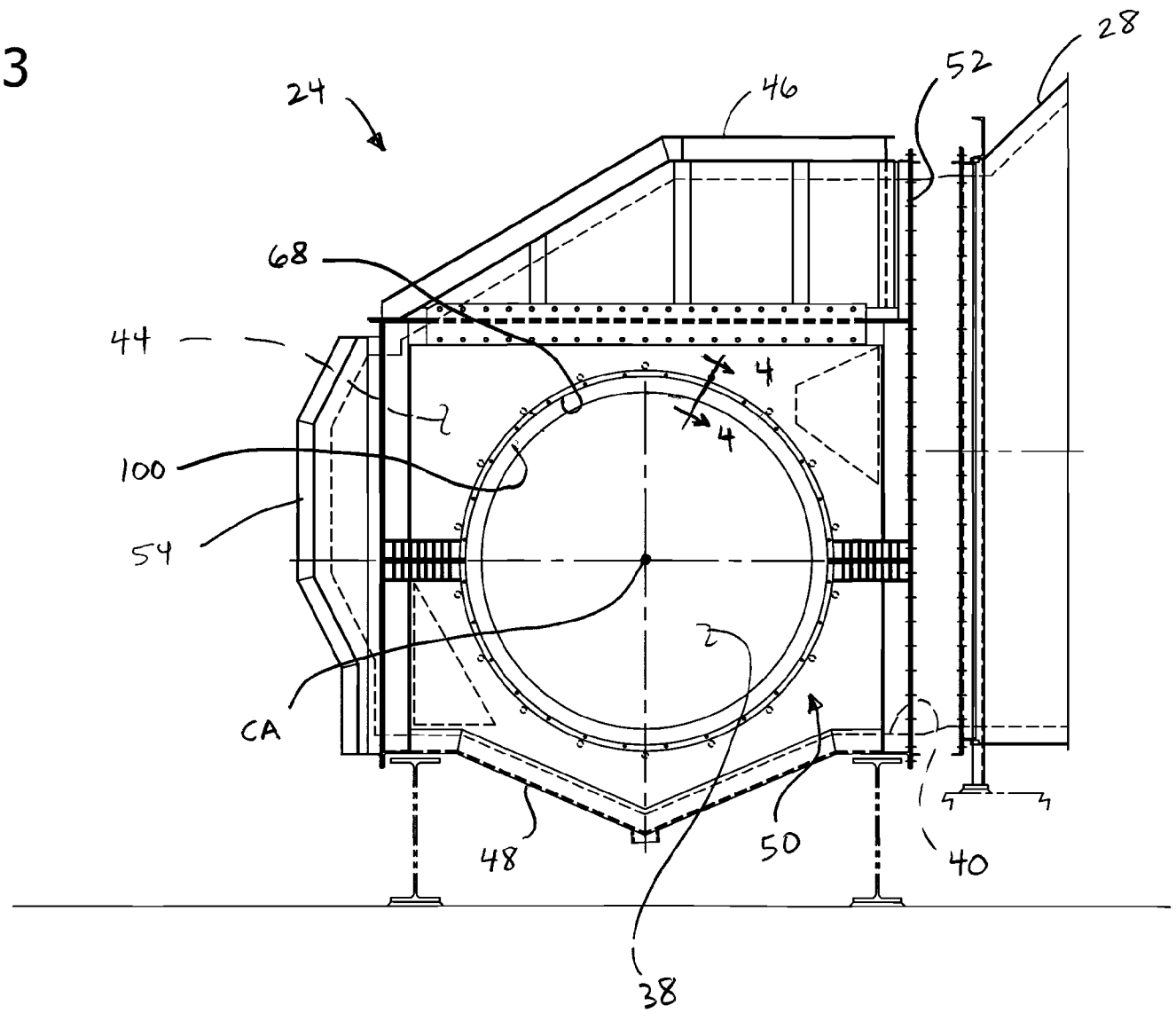
FIG. 3 is a front elevation of the exhaust plenum, which shows an exterior side of a forward wall (turbine side) of the exhaust plenum.

Referring now to FIGS. 2 and 3, the exhaust plenum 24 includes a plurality of walls defining an interior space 44 of the plenum. In particular, the illustrated plenum 24 includes a top 46 (i.e., cowl), a bottom 48, a turbine-side or forward wall, generally indicated at 50 (broadly, a first wall), defining the inlet 38, a side wall 52 (broadly, a second wall) defining the outlet 40, a closed opposing side wall 54 (i.e., wing), and a load-side or aft wall 56 (broadly, a third wall) opposing the forward wall and defining a drive shaft opening 58. The drive shaft opening 58 in the aft wall 56 is configured to allow the drive shaft 25 to pass therethrough, while inhibiting exhaust gas from passing therethrough. Thus, as set forth above, exhaust gas from the turbine engine 12 flows into the interior space 44 of the plenum 24 through the inlet 38 along the inlet flowpath F1, and exits the plenum through the outlet 40 along the outlet flowpath F2, which is generally transverse to (e.g., about 90 degrees offset from) the inlet flowpath.

Because of the relative positions of the inlet 38, the outlet 40, and the drive shaft opening 58, the illustrated exhaust plenum is generally referred to in the art as a "side-out plenum". Side-out plenums, including the illustrated plenum 24, may be suitable for use with General Electric gas turbine frames FS-6, FS-7, and FS-9. It is understood that the teachings of the present disclosure provided below are applicable to other types of exhaust plenums, and are not limited to side-out plenums, such as illustrated. For example, the teachings of the present disclosure provided below are applicable to vertical exhaust plenums, in which the outlet is defined by the top of the exhaust plenum. Such vertical exhaust plenums may be suitable for use with General Electric gas turbine frames FS-3 and FS-5. The teachings of the present disclosure provided below may be applicable to other types of exhaust plenums.

Figure 4:
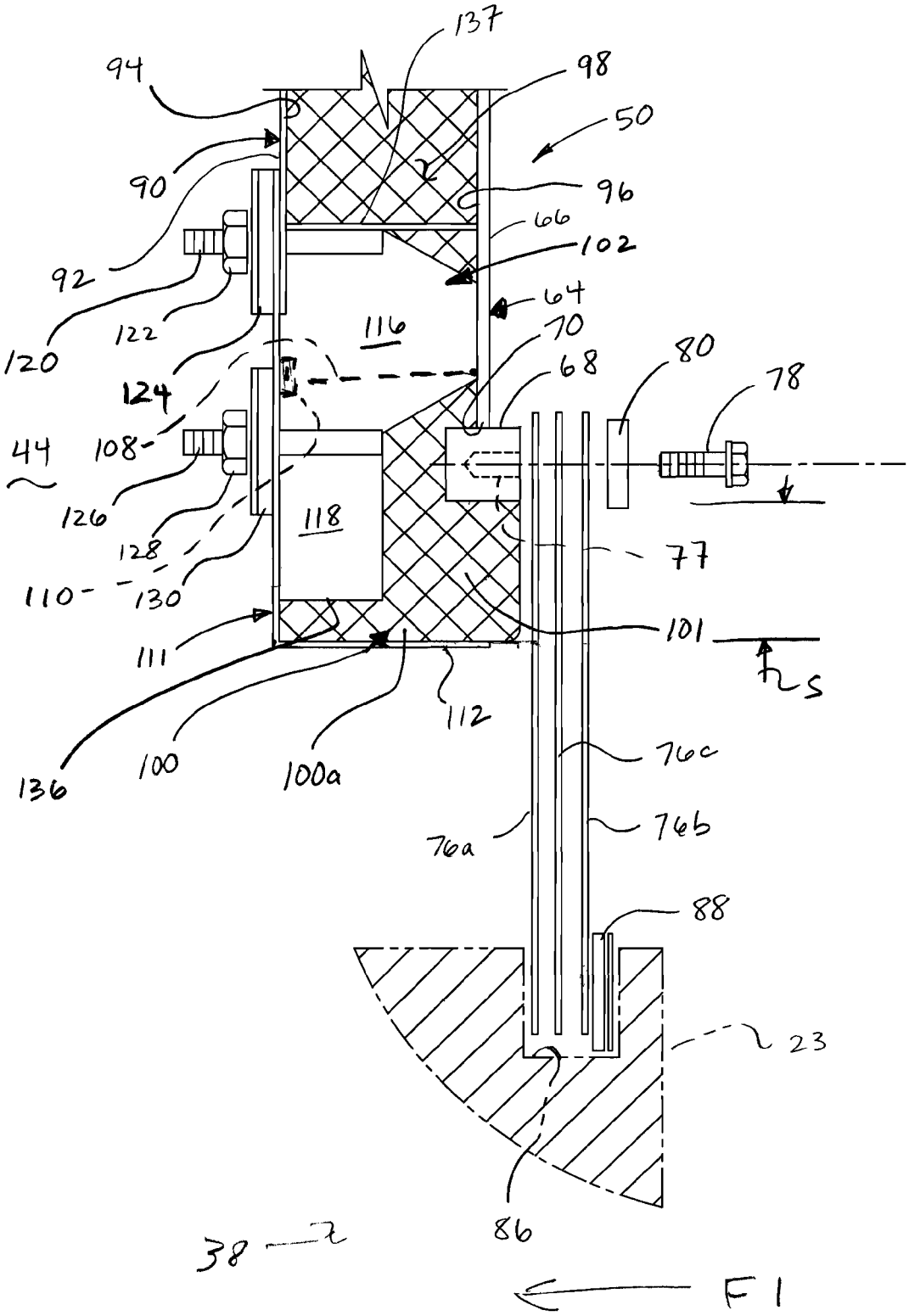
FIG. 4 is an enlarged, partial cross section of the forward wall of the exhaust plenum taken in a plane indicated by the line 4-4 in FIG. 3, showing sections of an exterior shell, a scallop bar, an interior liner, and an insulation member of the forward wall; and a section of flex seals and shown (not in FIG. 3) attaching the forward wall to the exhaust outlet of the turbine.
Figure 5A:
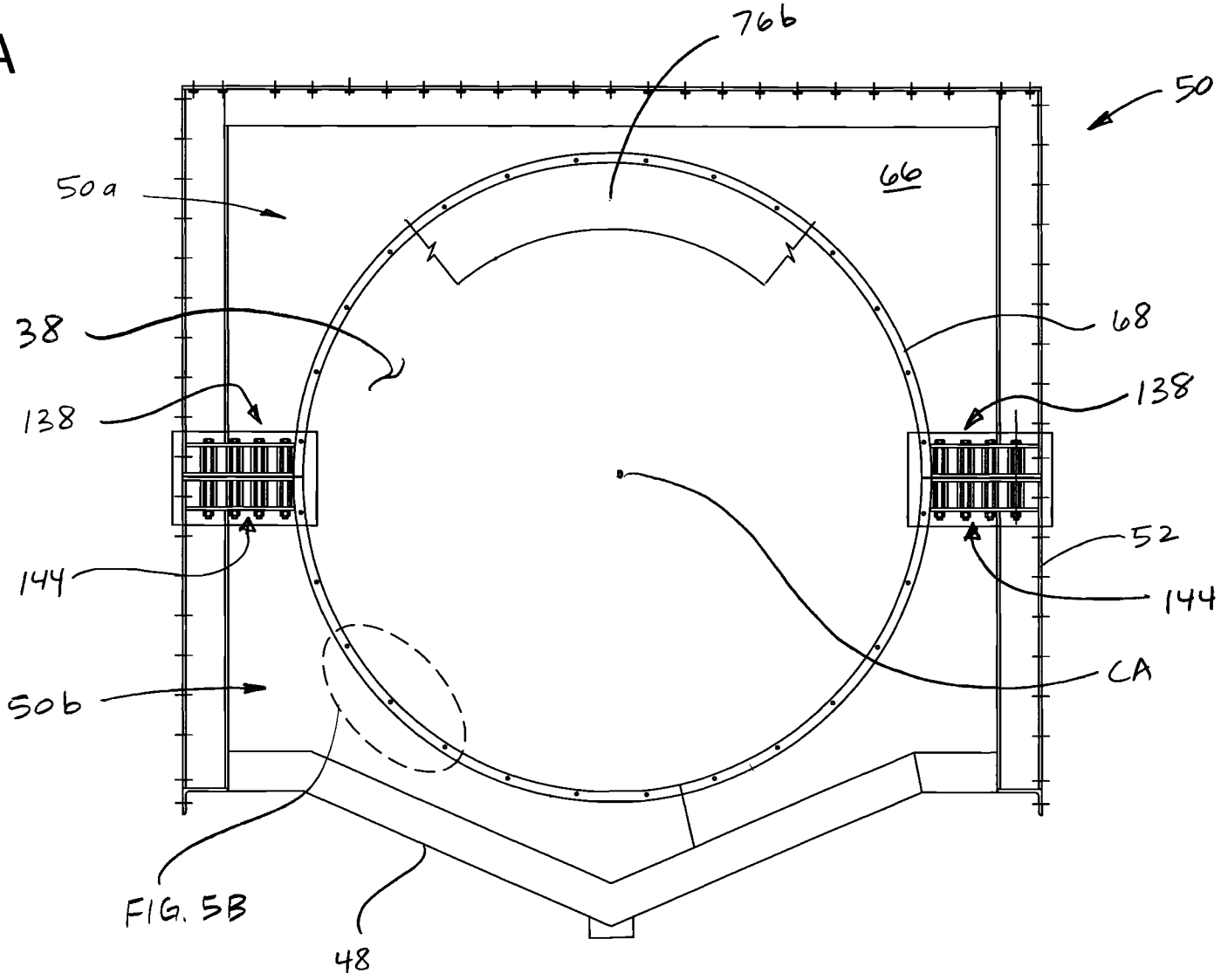
FIG. 5A is an enlarged elevation of the exterior side of the forward wall of FIG. 3, with the flex seals removed from the forward wall.
Figure 5B:
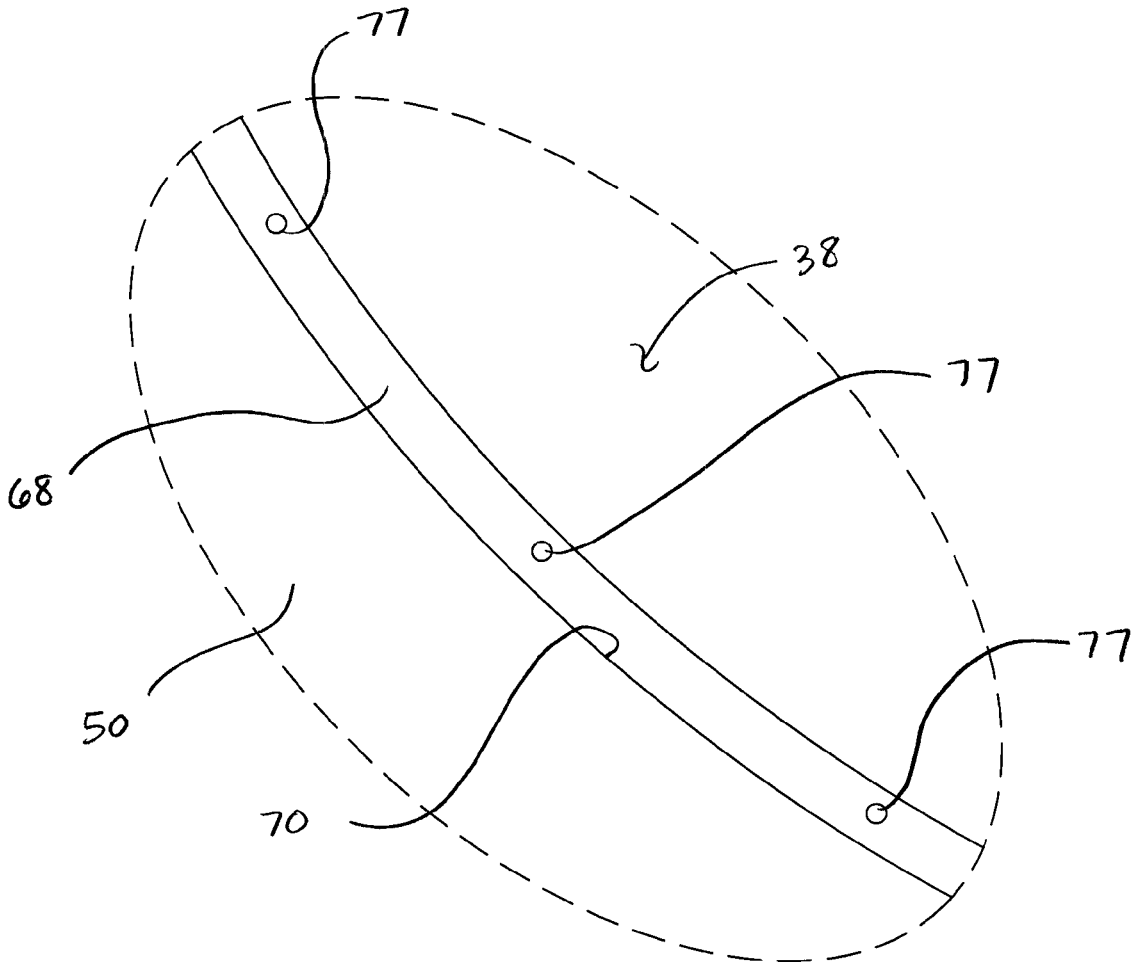
FIG. 5B is an enlarged fragmentary view of the exterior side of the forward wall as indicated in FIG. 5A.
Figure 8:
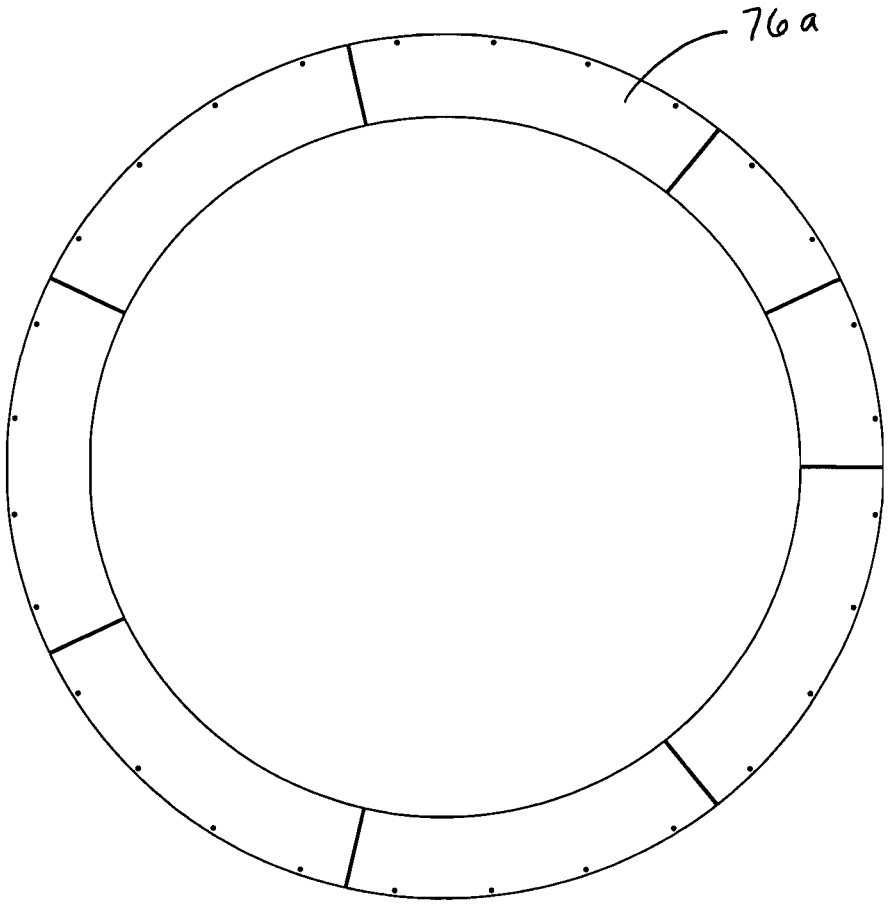
FIG. 8 is an enlarged front elevation of one of the annular flex seals.
Figure 9:
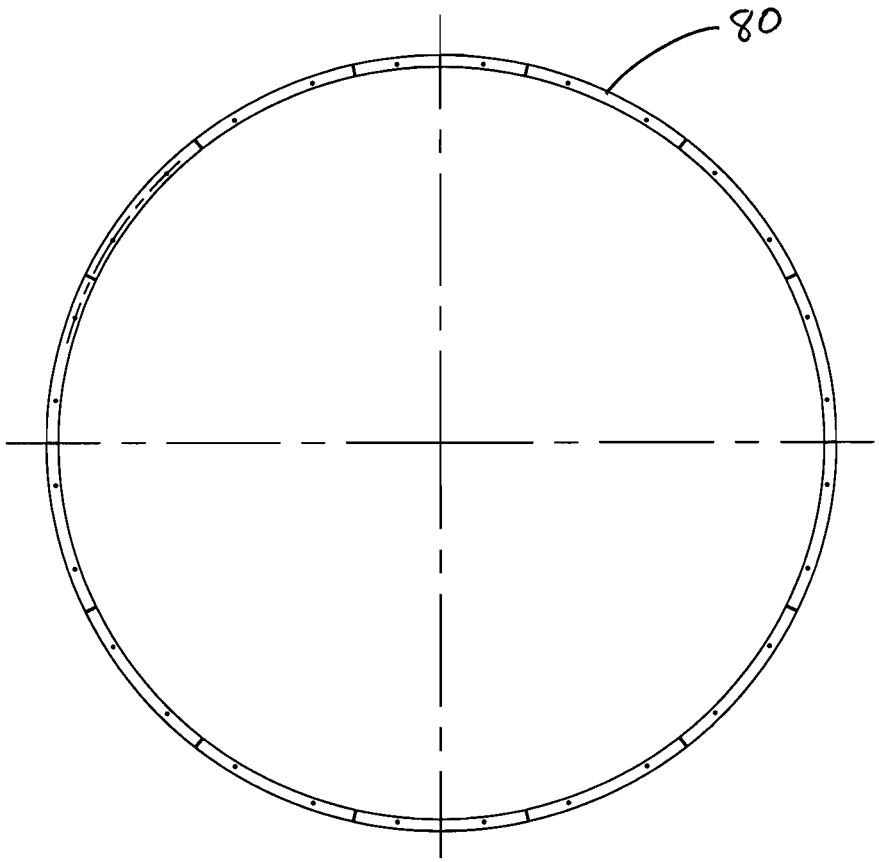
FIG. 9 is an enlarged front elevation of an annular clamping bar for use in attaching the flex seals to the forward wall.
Figure 10:
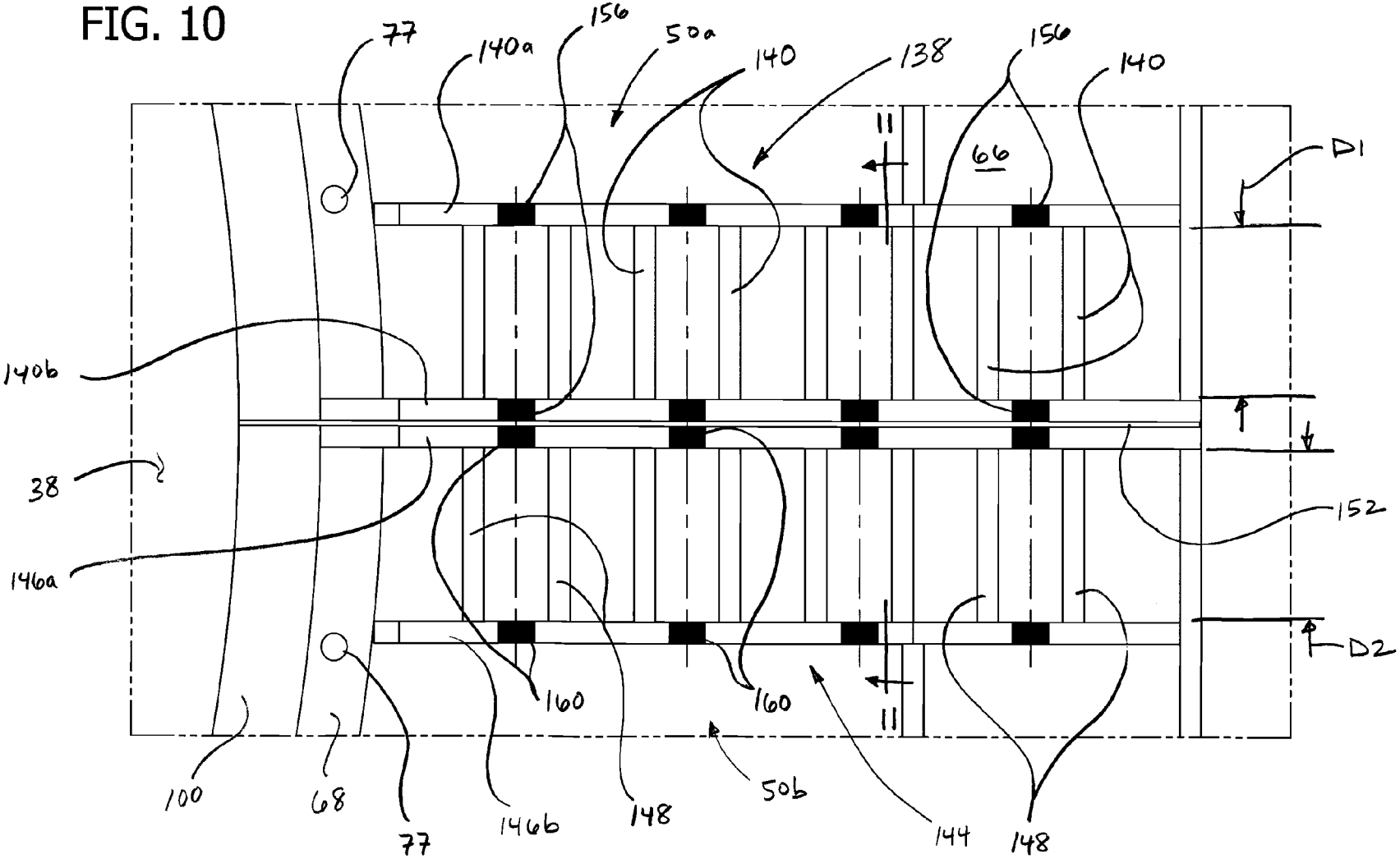
FIG. 10 is an enlarged fragmentary view of the exterior side of the forward wall as indicated in FIG. 5A, showing reinforced flanges of the forward wall.

Referring to FIG. 4, the forward wall 50 (indicated generally in FIG. 4) includes an exterior plate or shell 64 having an exterior surface 66 defining an exterior of the plenum 24. The exterior shell 64 may comprise metal or some other generally rigid and thermally conductive material. For example, the exterior shell 64 may comprise steel, or another suitable material. A continuous rolled seal attachment bar component 68 (broadly, a seal attachment component) is secured (e.g., welded) to the exterior shell 64 adjacent a radial inner edge 70 of the exterior shell that surrounds (i.e., extends around a perimeter of) the inlet 38 of the exhaust plenum 24. The seal attachment component 68 may comprise metal or some other generally rigid and thermally conductive material. The seal attachment component 68 is configured for attaching a flex seal to the forward wall 50. In the illustrated embodiment (FIGS. 4 and 8), the exhaust plenum 24 includes three flex seals—an interior flex seal 76*a*, an outer flex seal 76*b*, and an intermediate flex seal 76*c*—although the exhaust plenum may include any number of flex seals. The seal attachment component 68 contains a plurality of internally threaded inserts 77 for receiving threaded fasteners 78 (e.g., bolts). In particular, the threaded fasteners 78 extend through openings in an annular clamp bar 80, through openings in the flex seals 76*a*, 76*b*, 76*c* and thread into the respective internally threaded inserts 77 in the seal attachment component 68. The annular flex seals 76*a*, 76*b*, 76*c* extend radially inward relative to a center axis CA of the plenum inlet 38 and are secured to the exhaust outlet portion 23 of the turbine engine 12. In particular, radially inner edge portions of the respective annular flex seals 76*a*, 76*b*, 76*a* are received in an external circumferential groove 86 in the exhaust outlet portion 23 of the turbine engine 12. An annular shim 88 may also be received in the external circumferential groove 86.

Figure 6A:
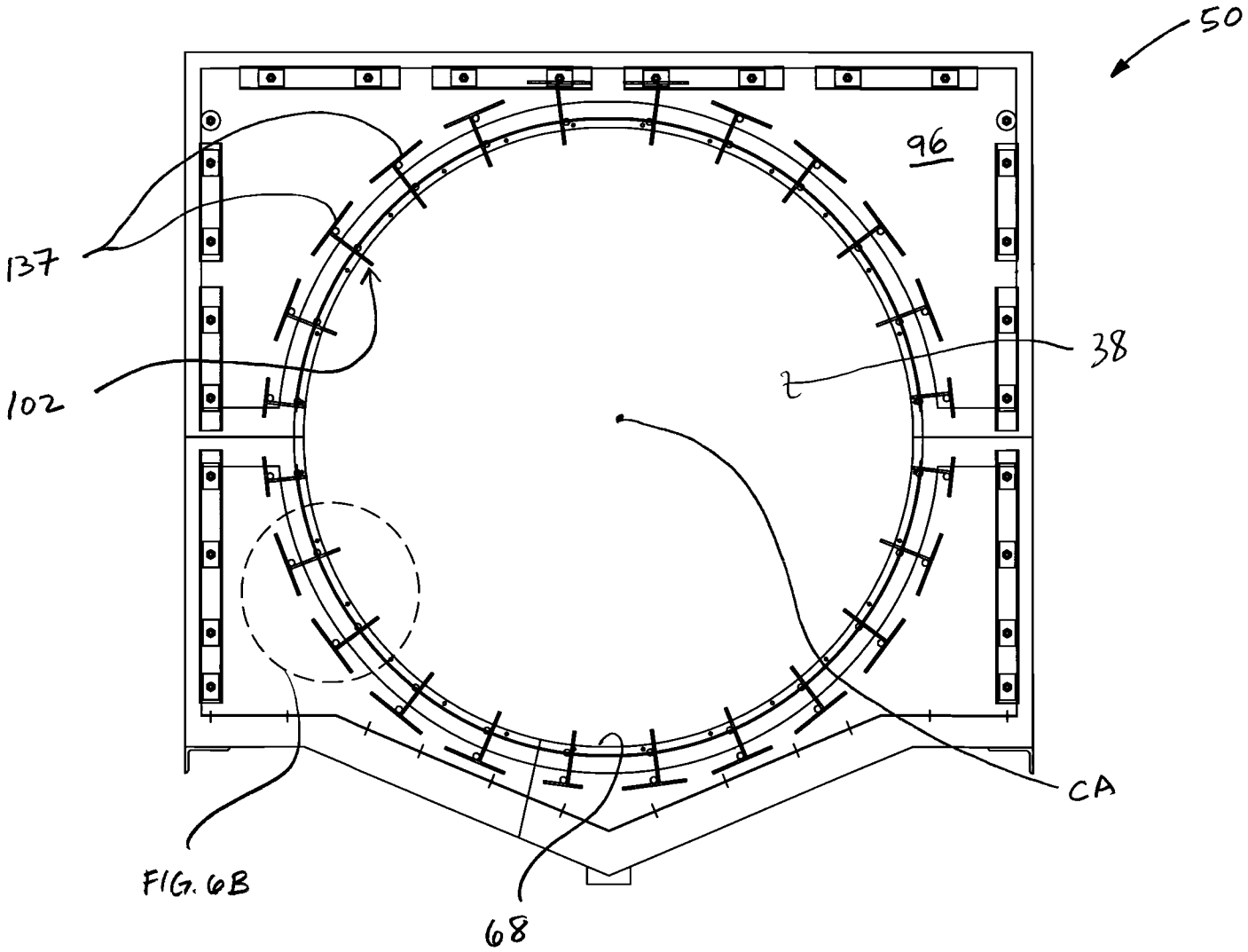
FIG. 6A is an enlarged elevation of the interior side of the forward wall of FIG. 3, with an insulation member and the interior liner removed to show hidden components.
Figure 7:
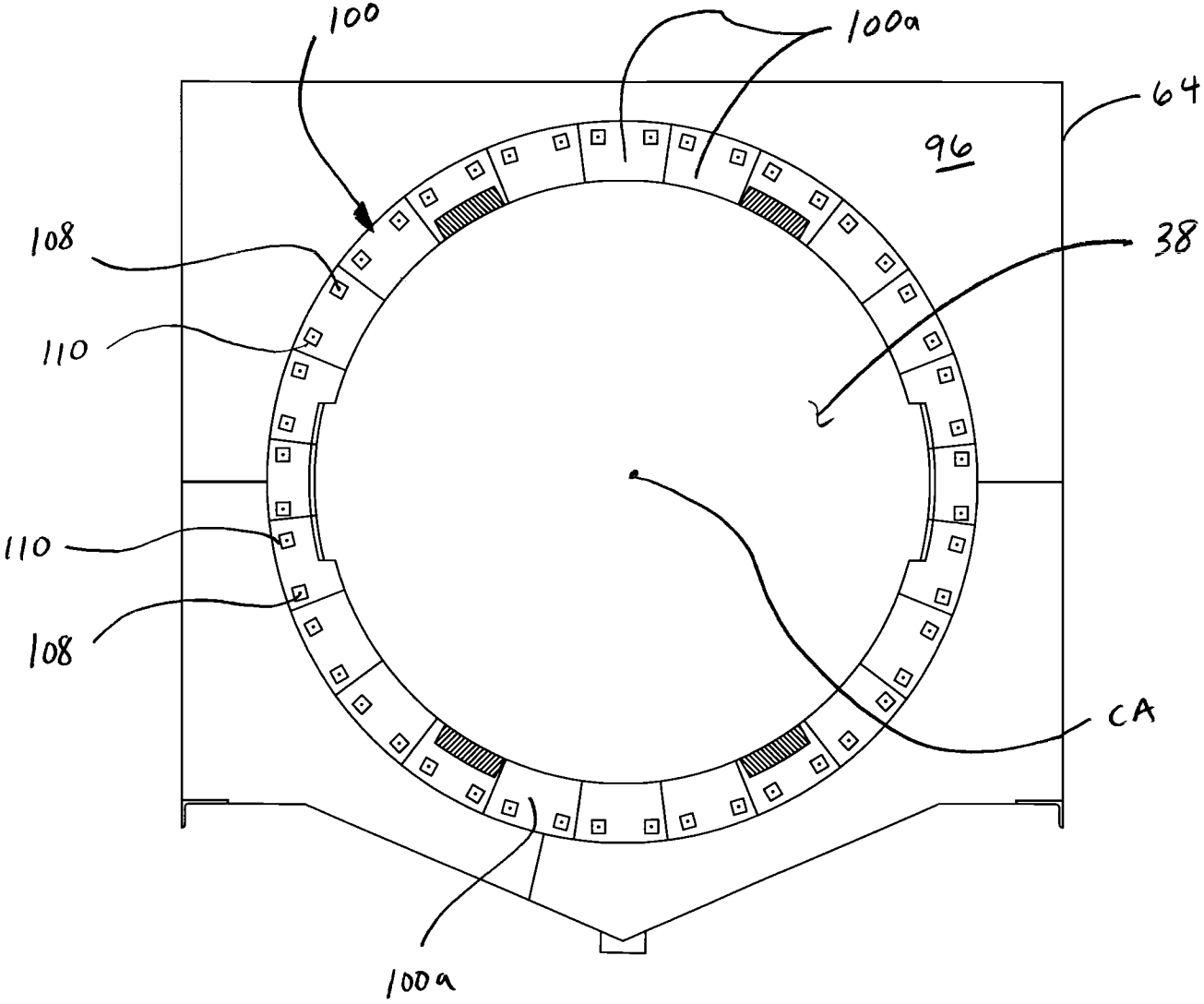
FIG. 7 is similar to FIG. 6A, except showing the insulation member secured to the interior side of the forward wall.

Referring to FIG. 4, the forward wall 50 also includes an interior plate or liner, generally indicated at 90, having an interior surface 92 partially defining the interior space 44 of the exhaust plenum 24. The interior liner 90 may comprise metal or some other generally rigid material and thermally conductive material. For example, the interior liner 90 may comprise stainless steel, or another suitable material. An exterior surface 94 of the interior liner 90 generally opposes and is spaced apart from an interior surface 96 of the exterior shell 64 to define a wall cavity 98 therebetween. An annular thermal insulation member, generally indicated at 100 (see FIGS. 4 and 7), and a plurality of scallop bars (broadly, spacers), generally indicated at 102 (see FIGS. 4 and 6A), which are circumferentially spaced apart from one another around the inlet 38, are received in the wall cavity 98. In the illustrated embodiment (shown in FIGS. 4 and 7), the thermal insulation member 100 at the inner radial edge portion of the forward wall 50 includes a plurality of segments 100*a* (e.g., arcuate segments), each of which is disposed between two adjacent scallop bars 102 and is sandwiched between the interior liner 90 and the exterior shell 64. Each thermal insulation segment 100*a* may comprise one or more insulation pillows 100. As an example, the insulation pillows may comprise calcium-magnesium-silicate insulation contained within a flexible container of mesh screen and cloth. As seen in FIGS. 4 and 7, the thermal insulation member 100 (e.g., the insulation pillows 100*a*) may be secured to the exterior shell 64 using insulation pins 108 secured (e.g., welded) to and extending outward from the interior surface 96 of the exterior shell, and speed clips 110 attached to the free ends of the pins. The thermal insulation member 100 may be secured to the exterior shell 64 in other ways.

As seen in FIG. 4, the thermal insulation member 100 at the radially inner edge portion of the forward wall 50 insulates the seal attachment component 68 from the interior space 44 of the exhaust plenum 24. At least a portion 101 of the of each thermal insulation pillow 100 is disposed radially inward of the seal attachment component 68 relative to the center axis CA of the inlet 38 so that the thermal insulation pillow insulates a portion of the seal attachment component that would otherwise be exposed to exhaust gas in the interior space 44 of the exhaust plenum 24. In this way, the transfer of heat from the exhaust gas in the interior space 44 of the plenum 24 to the seal attachment component 68 is reduced. It is understood that the thermal insulation member 100 may be of other types of thermal insulation, other than thermal insulation pillows. In one example, a ratio of an average thermal conductivity of the thermal insulation member 100 to an average thermal conductivity of the seal attachment component 68 is at least about 1:1330.

Referring still to FIG. 4, to further retain the thermal insulation member 100 in the wall cavity 98, an annular inner radial liner section, generally indicated at 111, of the interior liner 90 extends radially inward of the seal attachment component 68 relative to the center axis CA of the inlet 38. In one embodiment, such as the illustrated embodiment, the inner radial liner section 111 is formed separately from the remainder of the interior liner 90 and is secured thereto using the scallop bars 102, as explained below. The inner radial liner section 111 may be formed a single, one-piece construction or may be formed as separate arcuate sections secured to the interior liner 90. The inner radial liner section 111 includes an annular retaining flange 112 extending generally toward the exterior shell 64 but is spaced apart radially from the seal attachment component 68 relative to the center axis CA of the inlet 38 so that the corresponding portion 101 of the thermal insulation member 100 is sandwiched between the seal attachment component and the annular retaining flange. In one example, the spacing S between the seal attachment component 68 and the annular retaining flange 112 (which is filled with the portion 101 of the thermal insulation member 100) may be from about 6 in (about 15.2 cm) to about 12 in (about 30.5 cm). The annular retaining flange 112 extends toward the interior flex seal 76*a*, but does not contact the interior flex seal. Instead, the portion 101 of the thermal insulation member 100 disposed between the seal attachment component 68 and the annular retaining flange 112 contacts the interior flex seal 76*a*. As set forth below, in one example the inner radial liner section 111 of the interior liner 90 may be added to the interior liner 90 as a separate retrofit component.

Figure 6B:
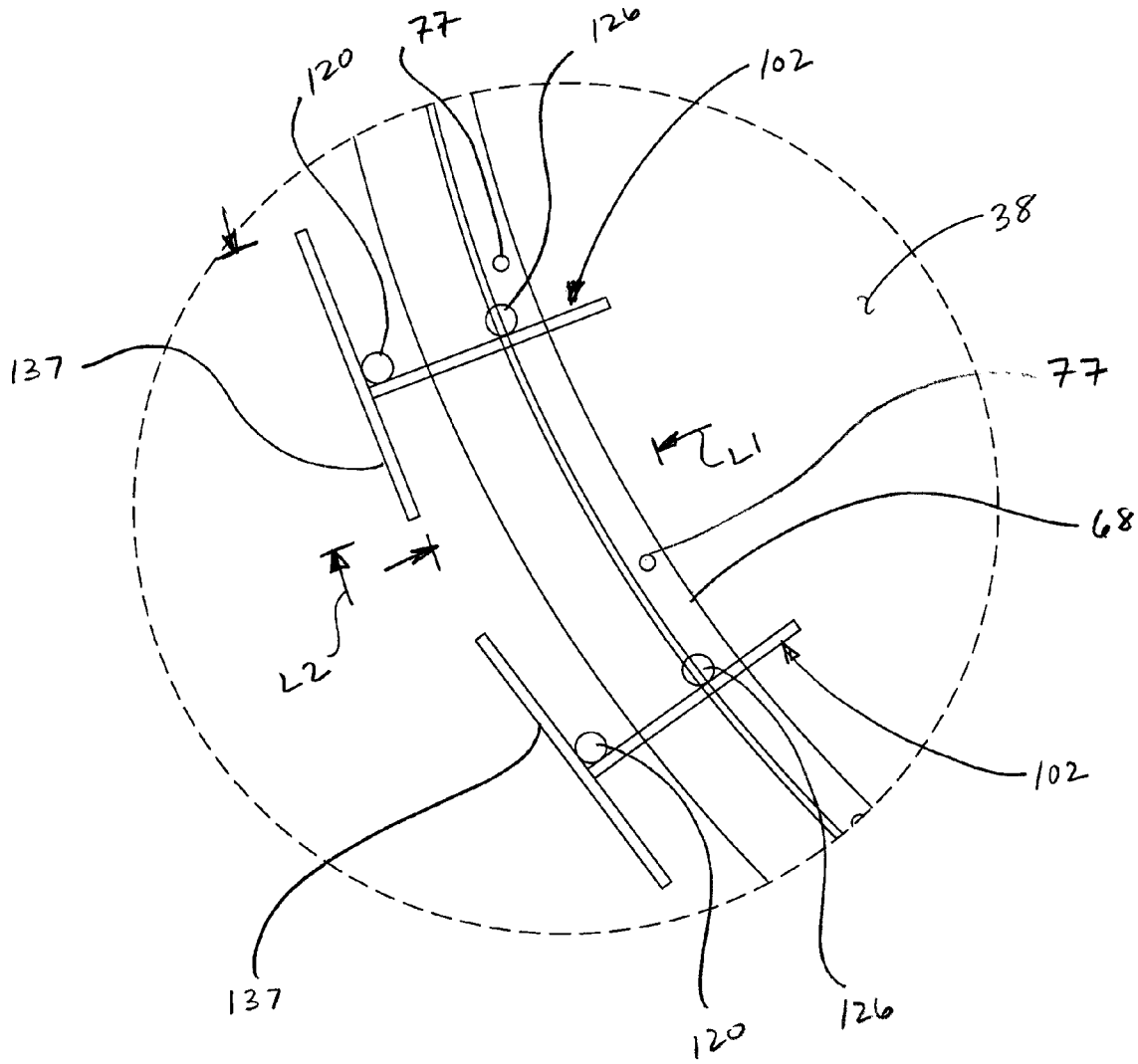
FIG. 6B is an enlarged fragmentary view of the interior side of the forward wall as indicated in FIG. 6A.

Referring to FIGS. 4 and 6B, each scallop bar 102 is generally P-shaped, and as seen best in FIG. 6B, each scallop bar has a length L1 extending generally radially relative to the center axis CA of the inlet 38 of the plenum 24. As shown in FIG. 4, each scallop bar 102 includes a bearing section 116 attached to and extending between the exterior shell 64 and the interior liner 90, and a liner-support section 118 secured to the interior liner (as described below) and extending radially inward relative to the inlet 38 of the exhaust plenum 24 from the bearing portion toward the annular retaining flange 112. The bearing section 116 retains the exterior shell 64 and the interior liner 90 in spaced apart, opposing relationship with one another. In one example, the bearing section 116 is welded to the interior surface 96 of the exterior shell 64, and a first threaded rod 120 (broadly, a first fastener), which receives nut 122 and a thermal insulation washer and/or clamping bar 124 on its free end portion, extends outward from the bearing section (i.e., toward the interior space 44). The first threaded rod 120 extends through an opening in the interior liner 90 and an opening in the inner radial liner section 111 of the interior liner to both secure the bearing section to the interior liner and secure the inner radial liner section to the remainder of the interior liner. The first threaded rod 120 (i.e., stud) may be welded to the bearing section 116 or otherwise secured thereto. The liner-support section 118 of each scallop bar 102 supports (i.e., provides rigidity to) the inner radial liner section 111 of the interior liner 90. In the illustrated embodiment, the liner-support section 118 is free from direct contact and attachment to the exterior shell 64. In one example, a second threaded rod 126 (broadly, a second fastener), which receives a nut 128 and a thermal insulation washer and/or clamping bar 130 on its free end portion, extends outward from the liner-support section 118 (i.e., toward the interior space 44) and through an opening in the inner radial liner section 111 of the interior liner 90 to secure the liner-support section to the interior liner. The second threaded rod 126 (i.e., stud) may be welded to the liner-support section 118 or otherwise secured thereto. In the illustrated embodiment, the liner-support section 118 has a terminal end 136 that is disposed radially inward of the seal attachment component 68 relative to the inlet 38 of the exhaust plenum 24. The terminal end 136 is also spaced apart from the retaining flange 112 of the interior liner 90 so that the terminal end is free from direct contact with the retaining flange. As shown in FIG. 4, the scallop bars 102 are also free from direct contact with the seal attachment component 68 to further reduce heat transfer from the interior liner 90 to the seal attachment component. The bearing and liner-support sections 116, 118, respectively, of each scallop bar 102 may be formed from a metal, such as stainless steel, or from other material.

Referring to FIGS. 4, 6A and 6B, a plurality of other wall support members 137 (e.g., additional scallop bars) are received in the wall cavity 98. These wall support members 137 are secured to and extend between the interior liner 90 and the exterior shell 64, and are positioned radially outward of the scallop bars 102 relative to the center axis CA of the inlet 38. Each wall support member 137 is welded or otherwise secured to the outer radial end of a corresponding scallop bar 102, and each wall support member has a length L2 (FIG. 6B) that is disposed generally transverse to the length of the attached scallop bar. Together, each pair of attached scallop bar 102 and wall support member 137 has a generally T-shape when viewing the interior side of the forward wall 50 (FIG. 6B). It is understood that the exhaust plenum 24 may not include the wall support member 137 without departing from the scope of the present invention.

Referring to FIGS. 5A and 10-12, in the illustrated embodiment the forward wall 50 includes upper and lower forward wall sections 50*a*, 50*b*, respectively. The lower forward wall section 50*b* may include left and right sections. The upper forward wall section 50*a* includes right and left flange sets, generally indicated at 138, each of which includes spaced apart upper and lower flange plates 140*a*, 140*b* (broadly, flanges), respectively. The right and left flange sets 138 are diametrically opposed from one another relative to the inlet 38. The respective upper and lower flange plates 140*a*, 140*b* of the right and left flange sets 138 extend outward (e.g., cantilever) from the exterior surface 66 of the exterior shell 64. In one example, the upper and lower flange plates 140*a*, 140*b* of each set 138 may be spaced apart from one another a distance D1 from about 8 in to about 3 in, and in one particular embodiment, about 5 in. Vertical stiffeners 140 are secured to and extend between the upper and lower flange plates 140*a*, 140*b* of each flange set 138. The lower forward wall section 50*b* likewise includes right and left flange sets, generally indicated at 144, each of which includes spaced apart upper and lower flange plates 146*a*, 146*b*, respectively. Vertical stiffeners 148 are secured to and extend between the upper and lower flange plates 146*a*, 146*b* of each flange set 144. In one example, the upper and lower flange plates 146*a*, 146*b* of each set 144 may be spaced apart from one another a distance D2 (FIG. 10) from about 8 in to about 3 in, and in one particular embodiment, about 5 in.

Figure 11:
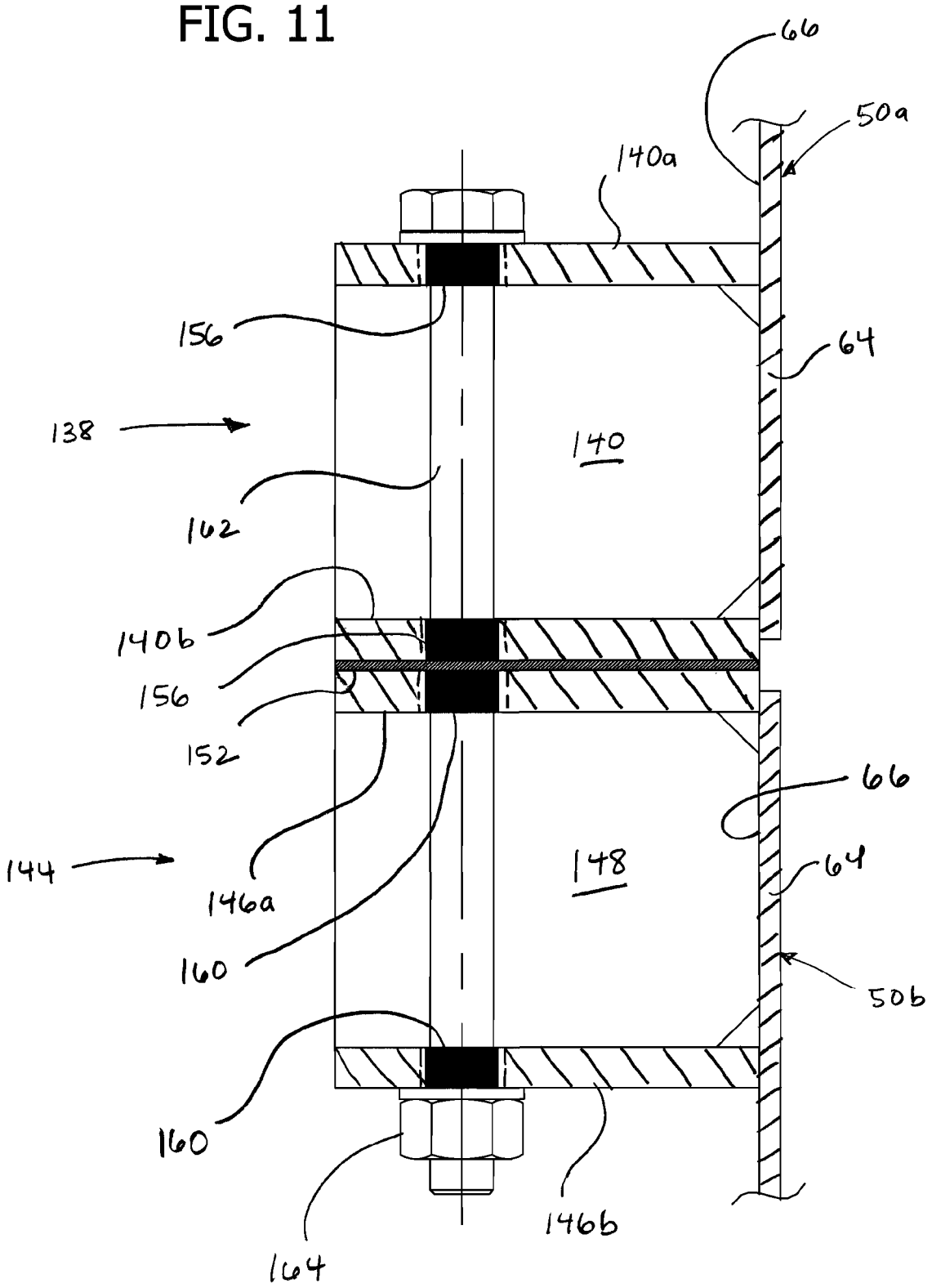
FIG. 11 is an enlarged, partial cross section of the reinforced forward wall flange of the exhaust plenum taken in a plane indicated by the line 11-11 in FIG. 10.

When the upper and lower forward wall sections 50*a*, 50*b* are assembled (i.e., when the upper forward wall section is stacked on the lower forward wall section), flat flange gaskets are disposed between the respective lower flange plates 140*b* of the upper forward wall section rest and the respective upper flange plates 146*a* of the lower forward wall section. The flange gaskets 152 may be solid, high temperature gaskets, and may comprise material such as tetra glass cloth, or other suitable high temperature gasket materials. Vertically aligned openings 156 in the flange plates 140*a*, 140*b* of the upper forward wall section 50*a* align with respective vertically aligned openings 160 in the flange plates 146*a*, 146*b* of the lower forward wall section 50*b*. As shown in FIG. 11, fasteners 162 (e.g., bolts) are inserted into respective aligned openings 156, 160 in the flange plates 140*a*, 140*b*, 146*a*, 146*b* and nuts 164 are threaded onto ends of the fasteners to secured the upper forward wall section 50*a* to the lower forward wall section 50*b*. In the illustrated embodiment, four bolts 162 are used to secure together the right flange sets 138, 144, and four bolts are used to secure together the left flange sets.

Figure 12:
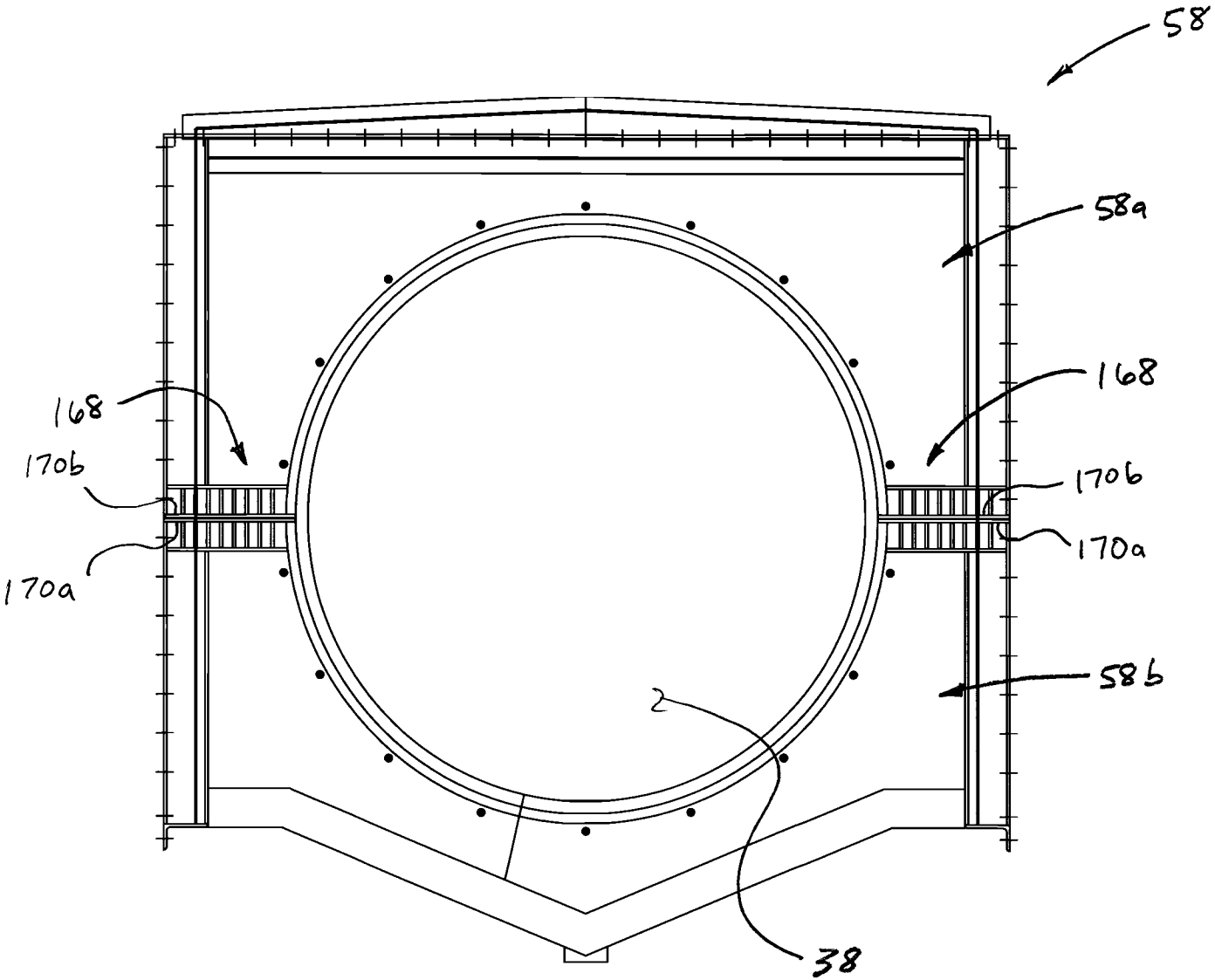
FIG. 12 is an enlarged rear elevation of an aft wall of the exhaust plenum of FIG. 2.

Referring to FIG. 12, the aft wall 58 (indicated generally in FIG. 12) includes upper and lower aft wall sections 58*a*, 58*b* that are secured to one another in the same way as the forward wall sections 50*a*, 50*b*. Each of the aft wall sections 58*a*, 58*b* includes right and left flange sets 168 having spaced apart upper and lower flange plates 170*a*, 170*b*, which are the same as the right and left flange sets of the forward wall. Accordingly, the teachings set forth above with respect to the flange sets 138, 144 of the forward wall 50 apply equally to the flange sets 168 of the aft wall 58. Briefly, gaskets (not shown), which may be the same type the gaskets 152 of the forward wall 50, are disposed between the upper flange plates 170*a* of the lower aft wall section 58*b* and the lower flange plates 170*b* of the upper aft wall section 58*a*, and fasteners (e.g., bolts, not shown) are inserted into respective aligned openings in the flange plates and nuts are threaded onto ends of the fasteners to secure the upper aft wall section to the lower aft wall section.

In one embodiment, the entire exhaust plenum 24 may of new construction. Thus, a newly constructed exhaust plenum 24 may include one or both of the new thermally insulated seal attachment component 68 and the new securement flange design. In another embodiment, an existing exhaust plenum may be retrofitted to include one or both of the new thermally insulated seal attachment component 68 and the new securement flange design. For example, an OEM exhaust plenum for the General Electric gas turbine frame FS-6 may be retrofitted to insulate the seal attachment component 68. In one exemplary process of retrofitting the OEM plenum for the GE FS-6 gas turbine frame, the existing inner radial liner section 111 of the interior liner 90 of the forward wall is removed. The OEM plenum will include the wall support members 137 (i.e., scallop bars including a threaded rod) and insulation that is disposed radially inward of the existing wall support members. The existing insulation that is disposed radially inward of the existing wall support members 137 is removed, and the threaded rods are removed from the existing wall support members 137. The new scallop bars 102 are welded or otherwise secured to the existing wall support member 137 as shown in FIG. 6B. The first threaded rods 120 of the scallop bars 102 are inserted into respective existing openings in the existing interior liner to replace the original (now removed) threaded rods. The insulation pins 108 are optionally welded or otherwise secured to the interior surface 96 of the exterior shell 64, and the new insulation pillows 100 (i.e., the thermal insulation member) are secured to the exterior shell using the installed insulation pins and the speed clips 110, as shown in FIGS. 4 and 7. Next, the new inner radial liner section 111 (e.g., arcuate sections thereof) for the interior liner 90—which includes an annular retaining flange 112—is secured to the existing interior liner by inserting the threaded rods 120, 126 of the new scallop bars 102 into respective openings in a new inner radial liner section 111 of the interior liner, placing the washers and/or clamping bars 124, 130 on the respective terminal ends of the threaded rods 120, 126, and then threading the nuts 122, 128 on the threaded terminal ends of the threaded rods.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An exhaust plenum for connection to an exhaust outlet portion of a gas turbine for receiving turbine exhaust gas therefrom, the exhaust plenum comprising:

an interior space;

a first wall defining an inlet of the exhaust plenum through which exhaust gas from the exhaust outlet portion of the gas turbine enters the interior space of the exhaust plenum; and a second wall defining an outlet of the exhaust plenum through which exhaust gas exits the interior space of the exhaust plenum, wherein the first wall includes an exterior shell having an interior-facing surface, an interior liner having an exterior-facing surface, wherein the exterior-facing surface of the interior liner generally opposes and is spaced apart from the interior-facing surface of the exterior shell to at least partially define a wall cavity therebetween, and a seal attachment component in thermal contact with the exterior shell of the first wall and adapted for attaching an annular flex seal to the first wall, the seal attachment component extending generally around a perimeter of the inlet of the exhaust plenum, wherein the seal attachment component is thermally insulated from the interior space of the exhaust plenum.

2. The exhaust plenum of claim 1, further comprising an annular flex seal attached to the seal attachment component and extending generally radially inward from the seal attachment component relative to the inlet of the exhaust plenum, wherein the annular flex seal is configured to attach and seal the first wall of the plenum to the exhaust outlet portion of the gas turbine.

3. The exhaust plenum of claim 1, wherein the first wall further includes a thermal insulation member disposed within the wall cavity of the first wall, wherein the thermal insulation member is disposed between the interior space of the exhaust plenum and at least a portion of the seal attachment component to thermally insulate the seal attachment component from the interior space of the exhaust plenum.

4. The exhaust plenum of claim 3, wherein the seal attachment component includes a plurality of blocks having internal threads for threadably receiving fasteners for attaching the annular flex seal to the first wall.

5. The exhaust plenum of claim 3, wherein the first wall further includes an annular flange extending outward from the interior liner of the first wall, the annular flange being located radially inward of the seal attachment component relative to the inlet of the exhaust plenum for use in retaining the insulation member in the wall cavity of the first wall.

6. The exhaust plenum of claim 3, wherein the first wall further includes a plurality of scallop bars in the wall cavity of the first wall and being spaced apart from one another around the inlet of the exhaust plenum, each scallop bar including a bearing portion attached to and extending between the exterior shell and the interior liner to retain the exterior shell and the interior liner in spaced apart, opposing relationship with one another, and a liner-support portion secured to the interior liner and extending radially inward from the bearing portion relative to the inlet of the exhaust plenum, the liner-support portion having a terminal end disposed radially inward of the seal attachment component relative to the inlet of the exhaust plenum.

7. The exhaust plenum of claim 6, wherein the bearing portion of each scallop bar is welded to the exterior shell, and the liner-support portion of each scallop bar is free from direct attachment to the exterior shell.

8. The exhaust plenum of claim 7, wherein the scallop bars are free from direct contact with the seal attachment component.

9. The exhaust plenum of claim 8, wherein each scallop bar further includes at least one threaded rod attaching the interior liner to the scallop bar.

10. The exhaust plenum of claim 9, wherein the at least one threaded rod includes a first threaded rod secured to and extending outward from the bearing portion, and a second threaded rod secured to and extending outward from the liner-support portion.

11. The exhaust plenum of claim 3, further comprising an annular flex seal attached to the seal attachment component and extending radially inward from the seal attachment component relative to the inlet of the exhaust plenum, wherein the annular flex seal has an inner radial liner section that is disposed radially inward of the insulation member relative to the inlet of the exhaust plenum and is configured to attach and seal the first wall of the plenum to the exhaust outlet portion of the gas turbine.

12. The exhaust plenum of claim 1, wherein the outlet of the exhaust plenum defines an outlet flowpath along which gas exits the interior space through the outlet, and the inlet of the exhaust plenum defines an inlet flowpath along which gas enters the interior space through inlet generally travels, wherein the outlet flowpath is about 90 degrees offset from the inlet flowpath.

13. The exhaust plenum of claim 12, further comprising a third wall generally opposing the first wall and defining a shaft opening, wherein an output shaft of the turbine extends through the inlet and the shaft opening when the exhaust plenum is attached to the exhaust plenum.

14. The exhaust plenum of claim 3, wherein a ratio of an average thermal conductivity of the thermal insulation member to an average thermal conductivity of the seal attachment component is at least about 1:1330.

15. A gas turbine system, the gas turbine system comprising:

a gas turbine including a rotatable turbine shaft, and an exhaust outlet portion through which turbine exhaust gas exits the gas turbine; and an exhaust plenum connected to the exhaust outlet portion of the gas turbine for receiving turbine exhaust gas therefrom, the exhaust plenum including an interior space;

a first wall defining an inlet of the exhaust plenum through which exhaust gas from the exhaust outlet portion of the gas turbine enters the interior space of the exhaust plenum; and a second wall defining an outlet of the exhaust plenum through which exhaust gas exits the interior space of the exhaust plenum, wherein the first wall of the exhaust plenum includes an exterior shell having an interior-facing surface, an interior liner having an exterior-facing surface, wherein the exterior-facing surface of the interior liner generally opposes and is spaced apart from the interior-facing surface of the exterior shell to at least partially define a wall cavity therebetween, and a seal attachment component attached to and in thermal contact with the exterior shell of the first wall, the seal attachment component extending along a generally arcuate path generally adjacent the perimeter of the inlet of the exhaust plenum, wherein the seal attachment component is thermally insulated from the interior space of the exhaust plenum; and an annular flex seal attached to the seal attachment component and extending radially inward from the seal attachment component relative to the inlet of the exhaust plenum, wherein the annular flex seal is attached to and seals the first wall of the plenum to the exhaust outlet portion of the gas turbine.

16. The gas turbine system of claim 15, wherein the first wall of the exhaust plenum further includes a thermal insulation member disposed within the wall cavity of the first wall, wherein the thermal insulation is disposed between the interior space of the exhaust plenum and at least a portion of the seal attachment component to thermally insulate the seal attachment component from the interior space of the exhaust plenum.

17. The gas turbine system of claim 16, wherein the exhaust plenum further includes a third wall generally opposing the first wall and defining a shaft opening, wherein the output shaft of the turbine extends through the inlet and the shaft opening when the exhaust plenum is attached to the exhaust plenum.

18. A method of retrofitting an exhaust plenum for a gas turbine, the exhaust plenum including a forward wall defining an inlet leading to an interior space of the exhaust plenum, the forward wall including an interior liner, an exterior shell in opposing, spaced apart relationship with the interior liner to define a wall cavity therebetween, and a seal-attachment component secured to the exterior shell for use in attaching a flex seal to the forward wall, the interior liner having an inner radial liner section at a radially inner end of the interior liner relative to a center axis of the inlet for retaining thermal insulation in the wall cavity, the method comprising:

removing the inner radial liner section of the interior liner;

removing existing thermal insulation retained in the wall cavity by the inner radial liner section of the interior liner;

securing a new thermal insulation member to the forward wall in a position adjacent to the seal attachment component such that the new thermal insulation member thermally insulates the seal attachment component from the interior space of the exhaust plenum.

19. An exhaust plenum for connection to an exhaust outlet portion of a gas turbine for receiving turbine exhaust gas therefrom, the exhaust plenum comprising:

an interior space;

a first wall defining an inlet of the exhaust plenum through which exhaust gas from the exhaust outlet portion of the gas turbine enters the interior space of the exhaust plenum; and a second wall defining an outlet of the exhaust plenum through which exhaust gas exits the interior space of the exhaust plenum, wherein the first wall includes an upper first wall section including an upper exterior liner and spaced apart right and left flange sets, each of the right and left flange set of the upper first wall section includes vertically spaced apart upper and lower flanges extending outward from the upper exterior liner, wherein the left upper flange of the upper first wall section has sets of openings vertically aligned with openings in the left lower flange of the upper first wall section, and the right upper flange of the upper first wall section has openings vertically aligned with openings in the right lower flange of the upper first wall section, and a lower first wall section including a lower exterior liner and spaced apart lower right and left flange sets, each of the lower right and left flange sets of the lower first wall section includes vertically spaced apart upper and lower flanges extending outward from the lower exterior liner, wherein the left upper flange of the lower first wall section has openings vertically aligned with openings in the left lower flange of the lower first wall section, and the right upper flange of the lower first wall section has openings vertically aligned with openings in the right lower flange of the lower first wall section, wherein the aligned openings in the right flange set of the upper first wall section are alignable with the respective aligned openings in the right flange set of the lower first wall section when the upper first wall section and the lower first wall section are assembled for receiving fasteners therethrough to secure the upper first wall section to the lower first wall section, wherein the aligned openings in the left flange set of the upper first wall section are alignable with the respective aligned openings in the left flange set of the lower first wall section when the upper first wall section and the lower first wall section are assembled for receiving fasteners therethrough to secure the upper first wall section to the lower first wall section.

20. The exhaust plenum set forth in claim 19, wherein the first wall further includes vertical stiffeners extending between the upper and lower flanges of each of the right and left flange sets of the respective upper and lower first wall sections.

* * * * *